US007982606B2

(12) United States Patent
Wu et al.

(10) Patent No.: US 7,982,606 B2
(45) Date of Patent: Jul. 19, 2011

(54) MICROWAVE MOTION DETECTOR WITH TARGET ANGLE DETECTION

(75) Inventors: XiaoDong Wu, Roseville, CA (US); Leslie Kendall Green, Applegate, CA (US)

(73) Assignee: Honeywell International Inc., Morristown, NJ (US)

( * ) Notice: Subject to any disclaimer, the term of this patent is extended or adjusted under 35 U.S.C. 154(b) by 490 days.

(21) Appl. No.: 12/237,080

(22) Filed: Sep. 24, 2008

(65) Prior Publication Data

US 2010/0073165 A1 Mar. 25, 2010

(51) Int. Cl.
*G08B 13/18* (2006.01)

(52) U.S. Cl. ..... 340/554; 340/540; 340/542; 342/27

(58) Field of Classification Search ..... 340/540, 340/541, 542, 554, 565; 342/27, 28, 53
See application file for complete search history.

(56) References Cited

U.S. PATENT DOCUMENTS

| | | | | |
|---|---|---|---|---|
| 5,652,567 | A * | 7/1997 | Traxler | 340/552 |
| 6,307,475 | B1 * | 10/2001 | Kelley | 340/573.1 |
| 6,791,458 | B2 * | 9/2004 | Baldwin | 340/522 |
| 7,079,029 | B2 * | 7/2006 | Tsuji | 340/552 |
| 7,399,970 | B2 * | 7/2008 | Micko | 250/342 |
| 7,705,730 | B2 * | 4/2010 | Royer | 340/552 |
| 7,796,033 | B2 * | 9/2010 | Green et al. | 340/554 |
| 2005/0043907 | A1 * | 2/2005 | Eckel et al. | 702/62 |
| 2008/0042832 | A1 * | 2/2008 | DiPoala | 340/541 |

* cited by examiner

*Primary Examiner* — Eric M Blount
(74) *Attorney, Agent, or Firm* — Barkume & Associates, P.C.

(57) ABSTRACT

The present invention is an alarm system that includes a dual technology motion sensor. The dual technology sensor includes a PIR sensor with a PIR detection pattern and a Doppler microwave frequency motion detector with a detection pattern wider than that of the PIR sensor. The microwave detector's processing circuitry distinguishes motion beyond the PIR detection pattern, and limits the microwave detector's field of view to match the PIR detector's detection pattern. The microwave detector has a transmitting antenna, two receiving antennas, and processing circuitry for processing received signals. The microwave detector's processing circuitry uses phase information from the two receiving antennas to distinguish motion beyond the PIR detection pattern.

17 Claims, 5 Drawing Sheets

Difference-pattern

Sum-pattern

MICROWAVE MOTION DETECTOR WITH TARGET ANGLE DETECTION

TECHNICAL FIELD

The present invention relates to security systems, and in particular to microwave frequency motion detectors used for monitoring a protected space.

BACKGROUND ART

Dual technology sensors in the security field combine passive infrared (PIR) sensors and microwave Doppler motion detectors to increase the reliability of detecting an intruder. A PIR sensor typically has a 90-degree detection pattern, allowing it to detect motion 45 degrees to the left of center and 45 degrees to the right of center, while a microwave detector typically has a detection pattern greater than 90 degrees (for example, 160 degrees), allowing it to detect motion at a much wider angle to the left and right of center. (In the example 80 degrees to the left of center and 80 degrees to the right of center). In order to provide complete coverage of a protected area by the PIR sensor, the dual technology sensor is typically mounted in a corner of the protected area. In this configuration the PIR sensor's detection pattern substantially matches the protected area, while the microwave detector's detection pattern is larger than the protected area and allows a moving object outside the protected area to be detected by the microwave detector. This may compromise the reliability of the dual-technology sensor. It is desirable to distinguish detected motion by the microwave detector that is outside the protected space from detected motion within the protected space, thereby limiting the microwave detector's field of view to the protected space and generate an alarm only when the detected motion is within the protected space. It is also desirable to generate a warning (not an alarm) when motion is detected outside the protected space and moving toward the protected space.

In a different situation, such as in a museum, it may be useful to be able to change the size of the microwave detector's field of view at selected times. For instance, when the museum is closed, the microwave detector covers the entire protected space while the PIR sensor only covers the area near an exhibit using a narrow beam lens. If the microwave detector detects motion inside the protected area that is going toward the exhibit, the sensor will generate a warning. If both the PIR sensor and the microwave detector detect motion, an alarm will be generated. However, when the museum is open, rather than covering the entire protected space, motion detection may only be required near an exhibit. This allows protection of the exhibit from being stolen or defaced and allows visitors to view the exhibit. Therefore, the visitor's motion should only set off an alarm when the visitor is too close to an exhibit. A single dual technology sensor that has a microwave detector with a variable field of view in accordance with this invention can provide intrusion detection for both of these situations. When the museum is closed, the field of view of the microwave detector is selected to equal the entire protected space. When the museum is open, however, the field of view of the microwave detector is narrowed to a smaller region that equals that of the PIR sensor.

Having the ability to select the microwave detector's field of view allows a dual technology sensor to be adapted to very specific situations. Another example of this is a long corridor/aisle, which can be protected by changing the lens for the PIR sensor and narrowing the microwave detector's field of view to match that of the PIR sensor.

It is an object of the present invention to distinguish between motion detected by a microwave detector that is outside a defined protected space and motion detected by a microwave detector that is inside the defined protected space.

It is a further object of the present invention to match the field of view of the microwave detector with the detection pattern of the PIR sensor.

It is a further object of the present invention to limit the field of view of the microwave detector to be narrower than the detection pattern of the PIR sensor.

It is a further object of the present invention to be able to select the microwave detector's field of view based on a condition, such as the time of day.

Finally, it is a further object of the present invention to generate a warning when the microwave detector detects motion that is outside the protected space and is moving toward the protected space.

DISCLOSURE OF THE INVENTION

The present invention is a method of limiting the field of view of a microwave motion detector. The microwave detector has a transmitting antenna (and transmitter), two receiving antennas (and associated receivers), and processing circuitry for processing the received signals. As known in the art, the microwave detector transmits microwave frequency signals via the transmitting antenna that are reflected off of a target and back to the microwave detector and received by the receiving antenna and associated receivers such that each receiving antenna provides a received signal in each of two separate channels. In the present invention, there are two receiving antennas that are substantially parallel and separated from each other by a distance that is less than the wavelength of the transmitted microwave frequency signal. The separation is a typical design feature known in the art to avoid phase ambiguity, however the precise separation is not a requirement of the present invention. The present invention only requires a known separation that is less than the wavelength of the transmitted microwave frequency signal.

When a signal is reflected from a target directly in front of the microwave detector, the phase of the signal received by both antennas/receivers is the same. However, when the reflected signal is from a target that is not directly in front of the microwave detector, there is a phase difference between the signals received by the two antennas/receivers in the separate channels. As the angle of the target from the center of the microwave detector's perpendicular direct line of sight increases, the phase difference increases. The microwave detector's processing circuitry uses this phase information to distinguish motion beyond an angle that corresponds to a selected field of view. The phase information is derived from the two received signals by adding and subtracting the two signals and taking the target ratio of the added and subtracted signals. As the target gets further from the microwave detector's perpendicular direct line of sight, the ratio gets smaller, as will be described below.

Thus, the method of the present invention includes the steps of transmitting a microwave frequency signal with the transmitting antenna, receiving microwave frequency signals reflected form a target with the two receiving antennas, each receiving antenna providing a received signal in each of two separate channels, determining a target ratio from a phase difference between each received signal in the separate channels, and disregarding motion from the target when the target ratio is less than a predetermined amount.

The target ratio may be determined by summing and mixing, with a portion of the transmitted microwave frequency signal, the two channels of received reflected signals to generate a sum pattern signal; subtracting and mixing, with a portion of the transmitted microwave frequency signal, the two channels of received reflected signals to generate a difference pattern signal; and determining the target ratio of the sum pattern signal and the difference pattern signal. The predetermined amount is a function of the antenna design and the angle required by the desired application. The method also includes the step of generating an alarm condition when the target ratio is more than a predetermined amount. It should be recognized that the target ratio may be inverted to be the ratio of the difference pattern to the sum pattern and an alarm condition is generated when the target ratio is less than a predetermined amount. The step of summing and mixing with a portion of the transmitted microwave frequency signal may be performed by first summing and then mixing the signals or by first mixing and then summing the signals. The step of subtracting and mixing with a portion of the transmitted microwave frequency signal may also be inverted. This is because the mixing with a portion of the transmitted microwave frequency signal converts the received reflected signals to intermediate frequency signals, as known in the art, and the summing and subtracting may be done with microwave frequency signals or with intermediate frequency signals.

The present invention is also an alarm system that includes a PIR sensor with a PIR detection pattern and a microwave motion detector with a microwave detection pattern that is wider than and overlaps the PIR detection pattern. The microwave detector's processing circuitry can distinguish the difference between motion beyond the PIR detection pattern and motion within the PIR detection pattern. This allows the alarm system to limit the microwave detector's field of view to match the PIR sensor's detection pattern. An alarm signal may be transmitted when the target ratio is more than a predetermined amount and the PIR sensor also detects the target. The predetermined amount corresponds to a target angle limit (which defines the microwave detector's field of view) that may be equal to or less than the PIR detection pattern. The target angle limit may be programmed during installation or may be automatically selected from a number of stored target angle limits based on a predefined condition occurring. The predefined condition may be a time of day, a day of week, a mode of operation, or some other external condition known to the alarm system. Once the target angle limit is selected, the target ratio is compared with a memory look up table to determine if it has exceeded the predetermined amount.

Finally, the microwave detector processing circuitry may generate a warning condition when the target is outside the protected space (or field of view) but moving towards it. The microwave detector generates the warning signal when the target ratio is less than a predetermined amount and when the target ratio has increased above the previous target ratio.

BEST MODE FOR CARRYING OUT THE INVENTION

Figure 1:
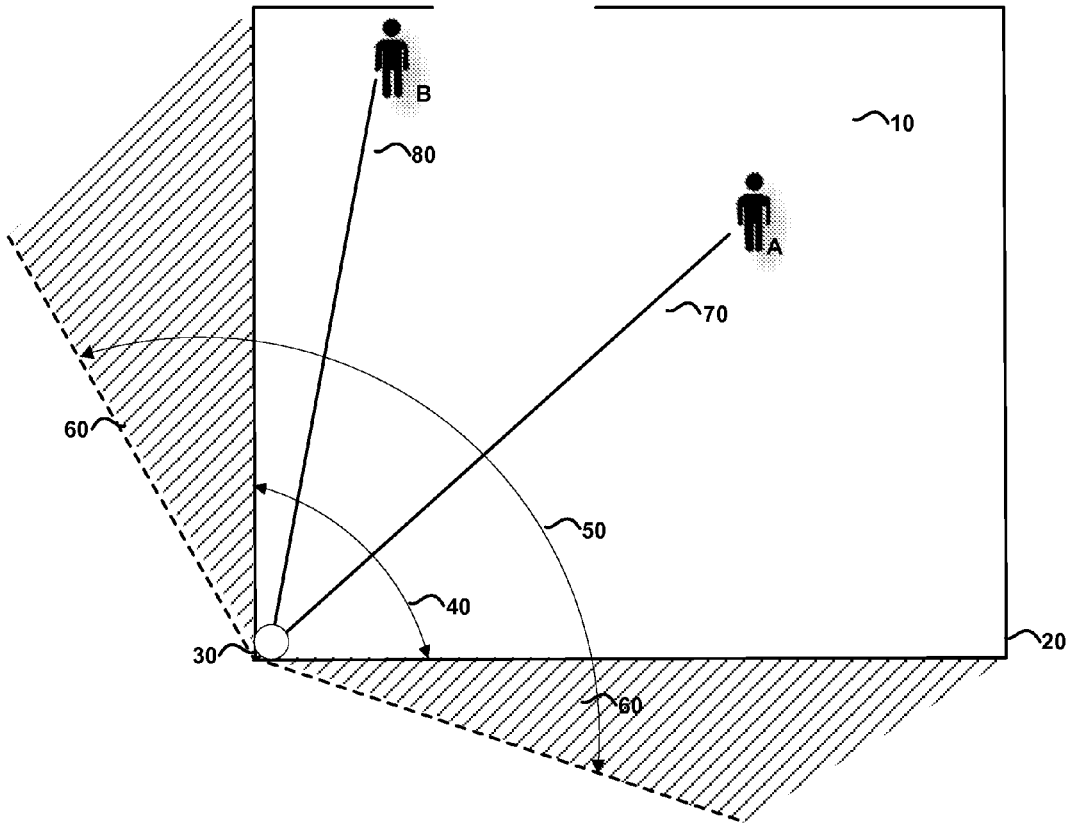
FIG. 1 is a diagram of the detection pattern of a preferred embodiment dual technology sensor of the present invention.

FIG. 1 shows a dual technology sensor 30 mounted in the corner of a protected space 10, having a PIR sensor and a microwave detector. The PIR sensor of the dual technology sensor 30 has a 90-degree detection pattern 40 that meets the perimeter 20 of the protected space 10 due to the corner placement of the dual-technology-sensor. The microwave detector of the dual-technology-sensor 30 has a pattern that typically is greater than that of the PIR pattern. The example of FIG. 1 shows a 160-degree detection pattern 50 that exceeds the perimeter 20 by 35 degrees on each side, as shown by hatched areas 60. Therefore, the microwave detector undesirably senses motion outside the protected space 10, which may compromise the reliability of the dual technology sensor 30 because the active microwave source can penetrate the wall while the passive IR only detects any change in heat change inside the room.

Figure 2:
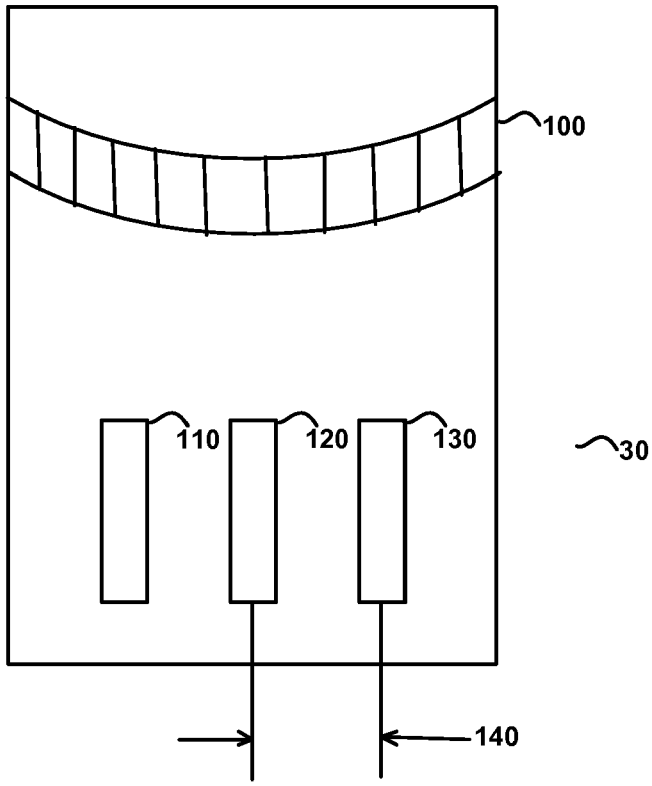
FIG. 2 is an illustration of a preferred embodiment dual technology sensor of the present invention.
Figure 3:
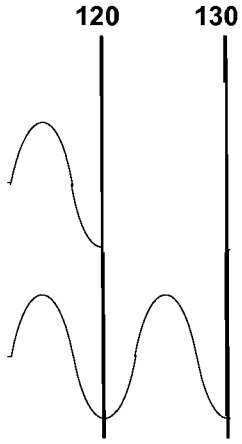
FIG. 3 is a drawing of the parallel microwave detector antennas/receivers in the preferred embodiment of the present invention.

FIG. 2 shows the dual technology sensor 30 of the present invention which includes the lens array 100 of the PIR sensor (not shown), the microwave antenna/transmitter 110, and two microwave antennas/receivers 120 and 130. The detection of motion by the PIR sensor is well known in the art and will not be discussed further. Also known to one skilled in the art is the operation of transmitting microwave signals by the antenna/transmitter 110 and the receipt of reflected microwave signals. In the present invention there are two microwave antennas/receivers 120 and 130, which are separated by a known distance 140, and which are substantially parallel. The known distance 140 is less than one wavelength of the transmitted microwave signal. The known distance 140 is typically approximately 0.7 times the wavelength of the transmitted microwave signal in order to avoid phase angle ambiguity. When target A is in a direct line of sight 70 of the dual technology sensor 30 (shown in FIG. 1), the antennas/receivers 120 and 130 receive the reflected transmitted microwave signal identically. However, when target B is not in the direct line of sight of the dual technology sensor 30 (such as when in line of sight 80 in FIG. 1), the antennas/receivers 120 and 130 receive the reflected transmitted microwave signals with a phase difference, as shown in FIG. 3. The difference in the phase between the signals received by the antennas/receivers 120 and 130 corresponds to the angle shift of the target from the direct line of sight of the dual technology sensor 30. Thus, the microwave detector's processing circuitry (described below) can determine the target angle, with respect to the direct line of sight. That is, the target angle is dependent on the two receiver antenna patterns and the distance between them.) During installation, the processing circuitry receives data associate with the location of the perimeter 20 with respect to the dual technology sensor from an installer and stores it as the target angle limit. During operation, the processing circuitry compares the computed target angle to the stored target angle limit to determine whether the target is outside the perimeter 20 of the protected space 10, such as the location of target B. Once the processing circuitry determines that the target is outside of the protected space 10, it disregards the motion detected from that target. In the museum example described above, the target angle limit may be smaller than the perimeter 20. Furthermore, the processing circuitry can determine if the target is moving towards the perimeter 20 from calculation of changes in the phase difference over a time period. The processing circuitry can use this information to generate a warning.

In order to accurately determine the phase difference between the signals received by the antennas/receivers 120 and 130 the two signals are added and subtracted and the ratio of the added and subtracted signals (the target ratio) is a precise indication of the phase difference, because the target angle is dependent on the two receiver antenna patterns and the distance between them.

Figure 5:
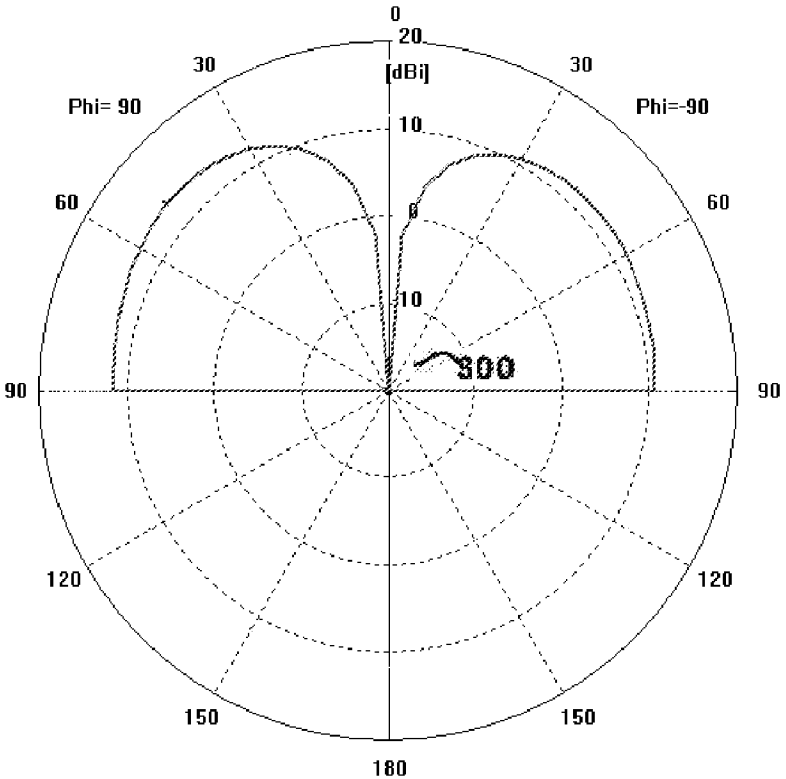
FIG. 5 is the difference pattern of the signals from the two receivers that correspond to each target angle in the preferred embodiment of the present invention.
Figure 4:
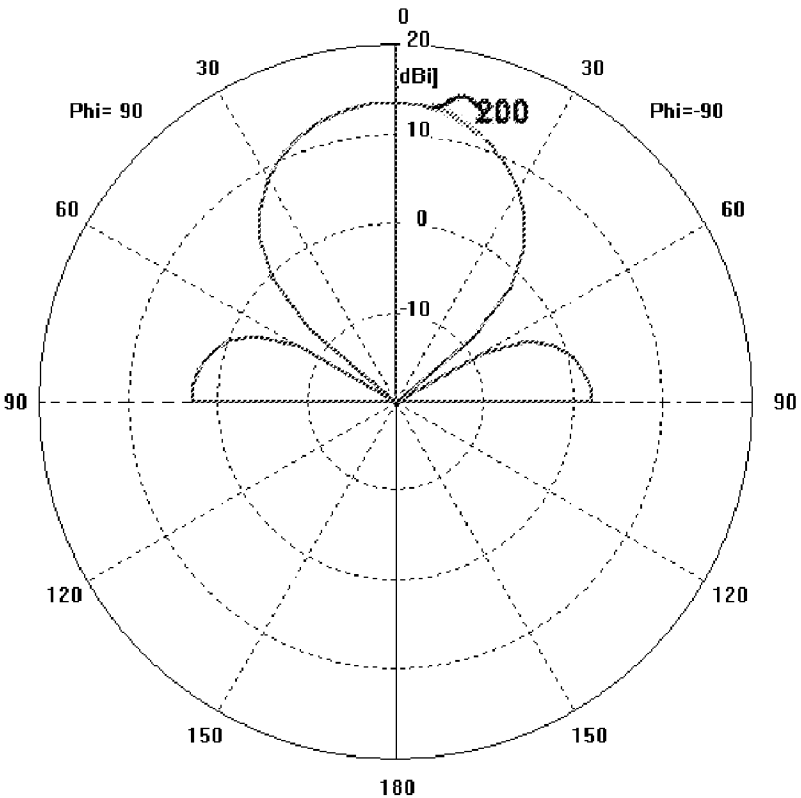
FIG. 4 is the sum pattern of the signals from the two receivers that correspond to each target angle in the preferred embodiment of the present invention.

FIG. 4 shows the sum-pattern and FIG. 5 shows the difference-pattern of the two signals from the microwave antennas/receivers 120 and 130. When a target A is in a direct line of sight 70 of the microwave antennas/receivers 120 and 130 (i.e. there is no phase difference) the sum-pattern has a maximum signal strength 200 and the difference-pattern has a minimum signal strength 300. The target ratio is the highest when target A is in a direct line of sight 70. As the target moves away from the direct line of sight, the difference-pattern rapidly increases causing the target ratio to become smaller. As shown in FIGS. 4 and 5, if the signal amplitude of sum-pattern and the signal amplitude of difference-pattern are equal, then the angle for the target is about 28 degrees.

Figure 6:
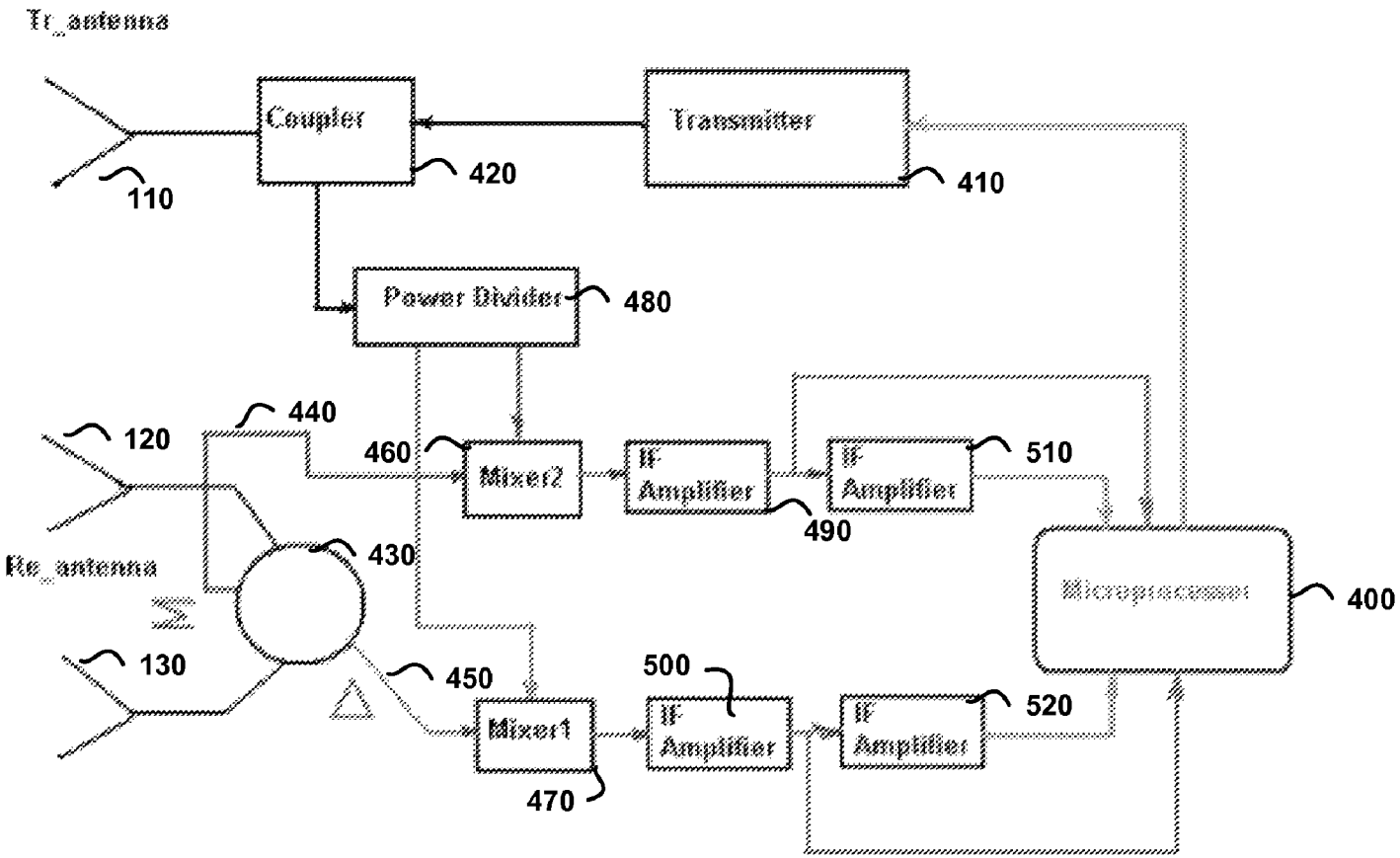
FIG. 6 is a block diagram of the preferred embodiment microwave detector of the present invention.

FIG. 6 is a circuit diagram of a preferred embodiment of the present invention. A microprocessor 400 initiates the transmitter 410 to transmit the microwave signal from the transmitter antenna 110. The receiving antennas 120 and 130 receive the reflected microwave signals, which are summed to generate a sum signal 440 and subtracted to generate a difference signal 450 by microwave circuits 430, which are known in the art. The conversion of the summed microwave signal 440 and the difference microwave signal 450 to intermediate frequency (IF) signals is performed by mixer circuits 460 and 470. In an alternative design, the summing 440 and the subtracting 450 may take place after the conversion of the reflected microwave signals to IF signals rather than before. In either case, in order to generate the IF signal, the mixers circuits 460 and 470 receive a portion of the transmitted microwave signal from coupler 420 which is divided down by power divider circuit 480. These circuits are all well known in the art. Each IF signal is amplified by two stages of amplifiers 490 and 510, and 500 and 520 respectively, and the outputs from each amplifier 490-520 are transmitted to the microprocessor 400. The microprocessor 400 determines which signals to process, if the signals exceed an alarm threshold level, and what the target angle is from the signals.

Figure 7:
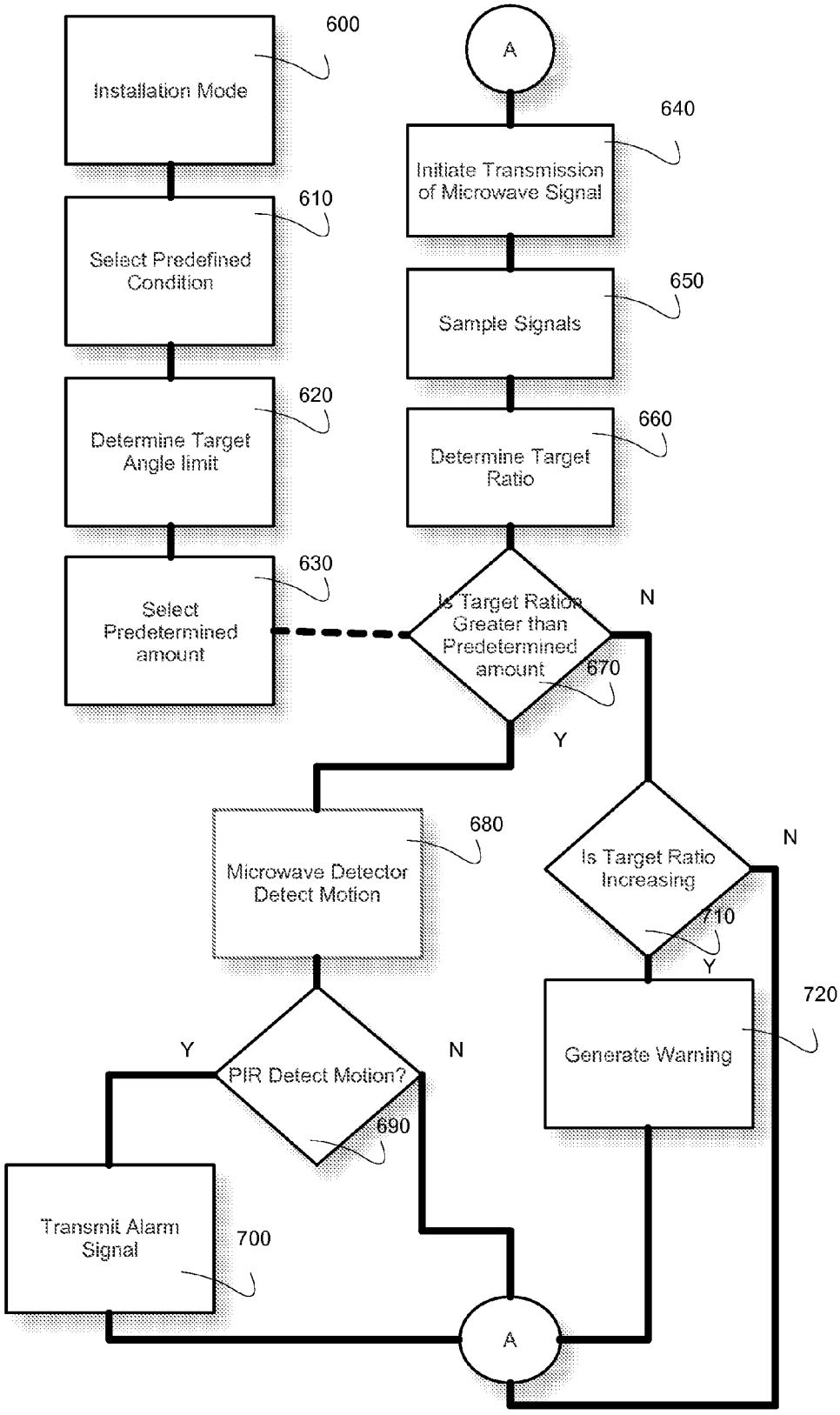
FIG. 7 is a flowchart of the operation of the alarm system of the preferred embodiment of the present invention.

FIG. 7 shows the processing flowchart of the alarm system. Prior to installation, a factory installed target angle limit (field of view of the microwave detector) is programmed into the microwave detector. This target angle limit would typically match the PIR detection pattern, but is not required to. During installation mode 600, a predefined condition is selected 610, which may be a time of day, a day of the week, or some other variable known to the alarm system such as a user input to a keypad. The predefined condition is used to determine when the target angle limit should change (for example in the museum situation). Alternatively, the target angle limit may be held constant and no predefined condition programmed into the alarm system. To change from the factory installed target angle limit and determine a new target angle limit 620, the perimeter 20 of the protected space 10 is entered into the alarm system. The target angle limit may be changed permanently, as in a narrow aisle, or may be adjusted during operation, as in the museum situation. For the target angle limit to be adjusted during operation, the predefined condition is monitored for a change and when that happens, the target angle limit is changed.

Next, a predefined amount is selected from memory based on the target angle limit 630. The predefined amount is a threshold level that the target ratio must be greater than if the motion is within the protected space 10.

During normal alarm system operation, the microprocessor 400 initiates the transmission of a microwave signal 640. The microprocessor 400 next determines, based on signal strength, which amplifier signals to sample 650 (490 and 500, or 510 and 520). The sampled signals are digitized and a target ratio is determined from ratio of the two signals 660. The target ratio is then compared to the predetermined amount 670 and if the target ratio is greater, then the microwave detector has detected motion within the protected space 680 and if the PIR has also detected motion 690, an alarm signal is transmitted 700. If the PIR has not detected motion, no alarm is transmitted. If the target ratio is not greater than the predetermined amount, the microprocessor 400 determines whether the target ratio has increased 710, signifying that a target is moving towards the protected space, and a warning is generated 720. If the target ratio has not increased, no warning is generated.

Although a preferred embodiment of the invention has been described above by way of example only, it will be understood by those skilled in the art that modifications may be made to the disclosed embodiment without departing from the scope of the invention.

We claim:

1. A method of limiting the field of view of a microwave motion detector comprising a transmitting antenna and two receiving antennas, comprising the steps of:

transmitting a microwave frequency signal with the transmitting antenna, receiving microwave frequency signals reflected from a target with the two receiving antennas, each receiving antenna providing a received signal in each of two separate channels, determining a target ratio from a phase difference between each received signal in the separate channels, and disregarding motion from the target when the target ratio is less than a predetermined amount.

2. The method of claim 1 wherein the step of determining a target ratio comprises the steps of:

summing and mixing, with a portion of the transmitted microwave frequency signal, the two channels of received reflected signals to generate a sum pattern signal;

subtracting and mixing, with a portion of the transmitted microwave frequency signal, the two channels of received reflected signals to generate a difference pattern signal; and determining the target ratio from the ratio of the sum pattern signal and the difference pattern signal.

3. The method of claim 1 further comprising the step of generating an alarm condition when the target ratio is more than a predetermined amount.

4. The method of claim 1 further comprising the steps of adapting the target angle limit to meet installation requirements.

5. The method of claim 1 further comprising the step of generating a warning signal when the target ratio is less than a predetermined amount and when the target ratio has increased above a previous target ratio.

6. A microwave motion detector comprising:

a transmitting antenna for transmitting microwave signals, two receiving antennas for receiving from each antenna reflected transmitted microwave signals from a target in two separate channels, and processing circuitry adapted to:

determine a target ratio from a phase difference between each signal in the separate channels, and disregard motion from the target when the target ratio is less than a predetermined amount.

7. The microwave motion detector of claim 6 wherein the processing circuitry is adapted to determine the target ratio by:

summing and mixing, with a portion of the transmitted microwave frequency signal, the two channels of received reflected signals to generate a sum pattern signal;

subtracting and mixing, with a portion of the transmitted microwave frequency signal, the two channels of received reflected signals to generate a difference pattern signal; and determining the target ratio from the ratio of the sum pattern signal and the difference pattern signal.

8. The microwave motion detector of claim 6 wherein the processing circuitry is further adapted to generate an alarm condition when the target ratio is more than a predetermined amount.

9. The microwave motion detector of claim 6 wherein the processing circuitry is further adapted to generate a warning signal when the target ratio is less than a predetermined amount and when the target ratio has increased above a previous target ratio.

10. An alarm system comprising:

a PIR sensor with a PIR detection pattern, a microwave motion detector with a microwave detection pattern that is wider than and overlaps the PIR detection pattern, wherein the microwave motion detector comprises a transmitting antenna for transmitting microwave signals and two receiving antennas for receiving reflected transmitted microwave signals from a target in two separate channels, and processing circuitry adapted to:

determine a target ratio from a phase difference between each signal in the separate channels, and disregard motion from the target when the target ratio is less than a predetermined amount.

11. The alarm system of claim 10 wherein the processing circuitry is adapted to determine the target ratio by:

summing and mixing, with a portion of the transmitted microwave frequency signal, the two channels of received reflected signals to generate a sum pattern signal;

subtracting and mixing, with a portion of the transmitted microwave frequency signal, the two channels of received reflected signals to generate a difference pattern signal; and determining the target ratio from the ratio of the sum pattern signal and the difference pattern signal.

12. The alarm system of claim 10 wherein the processing circuitry is further adapted to generate an alarm condition when the target ratio is more than a predetermined amount.

13. The alarm system of claim 10 wherein the processing circuitry is further adapted to transmit an alarm signal when the target ratio is more than the predetermined amount and the PIR sensor also detects the target.

14. The alarm system of claim 10 wherein the processing circuitry is further adapted to:

automatically select a target angle limit from a number of stored target angle limits based on a predefined condition occurring, and select from a memory look up table the predetermined amount that corresponds to the selected target angle limit.

15. The alarm system of claim 10 wherein the processing circuitry is further adapted to generate a warning signal when the target ratio is less than a predetermined amount and when the target ratio has increased above the previous determined target ratio.

16. The alarm system of claim 13 wherein the predetermined amount corresponds to a target angle that is equal to the PIR detection pattern.

17. The alarm system of claim 13 wherein the predetermined amount corresponds to a target angle that is less than the PIR detection pattern.

* * * * *